US008312931B2

(12) United States Patent
Xu et al.

(10) Patent No.: US 8,312,931 B2
(45) Date of Patent: Nov. 20, 2012

(54) FLOW RESTRICTION DEVICE

(75) Inventors: Yang Xu, Houston, TX (US); Martin P. Coronado, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/871,685

(22) Filed: Oct. 12, 2007

(65) Prior Publication Data

US 2009/0095487 A1 Apr. 16, 2009

(51) Int. Cl.
*E21B 43/12* (2006.01)

(52) U.S. Cl. ..... 166/373; 166/319; 166/370; 166/386; 138/42

(58) Field of Classification Search ..... 166/370, 166/373, 319, 386; 138/42
See application file for complete search history.

(56) References Cited

U.S. PATENT DOCUMENTS

| | | | | |
|---|---|---|---|---|
| 1,362,552 | A | 12/1920 | Alexander et al. | |
| 1,649,524 | A | 11/1927 | Hammond | |
| 1,915,867 | A * | 6/1933 | Penick | 138/42 |
| 1,984,741 | A | 12/1934 | Harrington | |
| 2,089,477 | A | 8/1937 | Halbert | |
| 2,119,563 | A | 6/1938 | Wells | |
| 2,214,064 | A | 9/1940 | Niles | |
| 2,257,523 | A | 9/1941 | Combs | |
| 2,400,161 | A * | 5/1946 | Mockridge et al. | 138/42 |
| 2,412,841 | A | 12/1946 | Spangler | |
| 2,762,437 | A | 9/1956 | Egan et al. | |
| 2,810,352 | A | 10/1957 | Tumilson | |
| 2,814,947 | A | 12/1957 | Stegemeier et al. | |
| 2,942,668 | A | 6/1960 | Maly et al. | |
| 2,945,541 | A | 7/1960 | Maly et al. | |
| 3,326,291 | A | 6/1967 | Zandmer | |
| 3,385,367 | A | 5/1968 | Kollsman | |

(Continued)

FOREIGN PATENT DOCUMENTS

CN 1385594 12/2002

(Continued)

OTHER PUBLICATIONS

Optimization of Commingled Production Using Infinitely Variable Inflow Control Valves; M.M, J. J. Naus, Delft University of Technology (DUT), Shell International Exploration and production (SIEP); J.D. Jansen, DUT and SIEP; SPE Annual Technical Conference and Exhibition, Sep. 26-29, Houston, Texas, 2004, Society of Patent Engineers.

(Continued)

*Primary Examiner* — Giovanna Wright
(74) *Attorney, Agent, or Firm* — Mossman, Kumar & Tyler, PC

(57) ABSTRACT

An inflow control device may include flow control elements along a flow path. The flow control elements may change the inertial direction of the fluid flowing in the flow path. The change in inertial direction occurs at junctures along the flow path. The flow control elements may also be configured to form segmented pressure drops across the flow path. The segmented pressure drops may include a first pressure drop segment and a second pressure drop segment that is different from the first pressure drop segment. The pressure drop segments may be generated by a passage, an orifice or a slot. In embodiments, the plurality of flow control elements may separate the fluid into at least two flow paths. The flow control elements may also be configured to cause an increase in a pressure drop in the flow path as a concentration of water increases in the fluid.

13 Claims, 8 Drawing Sheets

U.S. PATENT DOCUMENTS 3,419,089 A 12/1968 Venghiattis
3,451,477 A 6/1969 Kelley
3,675,714 A 7/1972 Thompson
3,692,064 A * 9/1972 Hohnerlein et al. ..... 138/42
3,739,845 A 6/1973 Berry et al.
3,791,444 A 2/1974 Hickey
3,876,471 A 4/1975 Jones
3,918,523 A 11/1975 Stuber
3,951,338 A 4/1976 Genna
3,975,651 A 8/1976 Griffiths
4,153,757 A 5/1979 Clark
4,173,255 A 11/1979 Kramer
4,180,132 A 12/1979 Young
4,186,100 A 1/1980 Mott
4,187,909 A 2/1980 Erbstoesser
4,248,302 A 2/1981 Churchman
4,250,907 A 2/1981 Struckman et al.
4,257,650 A 3/1981 Allen
4,287,952 A 9/1981 Erbstoesser
4,415,205 A 11/1983 Rehm et al.
4,434,849 A 3/1984 Allen
4,491,186 A 1/1985 Alder
4,497,714 A 2/1985 Harris
4,552,218 A 11/1985 Ross et al.
4,572,295 A 2/1986 Walley
4,614,303 A 9/1986 Moseley et al.
4,649,996 A 3/1987 Kojicic et al.
4,782,896 A 11/1988 Witten
4,821,800 A 4/1989 Scott
4,856,590 A 8/1989 Caillier
4,917,183 A 4/1990 Gaidry et al.
4,944,349 A 7/1990 Von Gonten, Jr.
4,974,674 A 12/1990 Wells
4,998,585 A 3/1991 Newcomer et al.
5,004,049 A 4/1991 Arterbury
5,016,710 A 5/1991 Renard et al.
5,132,903 A 7/1992 Sinclair
5,156,811 A 10/1992 White
5,333,684 A 8/1994 Walter et al.
5,337,821 A 8/1994 Peterson
5,339,895 A 8/1994 Arterbury et al.
5,377,750 A 1/1995 Arterbury et al.
5,381,864 A 1/1995 Nguyen et al.
5,431,346 A 7/1995 Sinaisky
5,435,393 A 7/1995 Brekke et al.
5,435,395 A 7/1995 Connell
5,439,966 A 8/1995 Graham et al.
5,551,513 A 9/1996 Surles et al.
5,586,213 A 12/1996 Bridges et al.
5,597,042 A 1/1997 Tubel et al.
5,609,204 A 3/1997 Rebardi et al.
5,673,751 A 10/1997 Head et al.
5,803,179 A 9/1998 Echols
5,829,522 A 11/1998 Ross
5,831,156 A 11/1998 Mullins
5,839,508 A 11/1998 Tubel et al.
5,873,410 A 2/1999 Iato et al.
5,881,809 A 3/1999 Gillespie et al.
5,896,928 A 4/1999 Coon
5,982,801 A 11/1999 Deak
6,068,015 A 5/2000 Pringle
6,098,020 A 8/2000 den Boer
6,112,815 A 9/2000 Boe et al.
6,112,817 A 9/2000 Voll
6,119,780 A 9/2000 Christmas
6,228,812 B1 5/2001 Dawson et al.
6,253,847 B1 7/2001 Stephenson
6,253,861 B1 7/2001 Carmichael et al.
6,273,194 B1 8/2001 Hiron
6,305,470 B1 10/2001 Woie
6,338,363 B1 1/2002 Chen et al.
6,367,547 B1 4/2002 Towers et al.
6,371,210 B1 4/2002 Bode et al.
6,372,678 B1 4/2002 Youngman et al.
6,419,021 B1 7/2002 George et al.
6,474,413 B1 11/2002 Barbosa et al.
6,505,682 B2 1/2003 Brockman
6,516,888 B1 2/2003 Gunnerson et al.
6,581,682 B1 6/2003 Parent et al.
6,622,794 B2 9/2003 Zisk
6,632,527 B1 10/2003 McDaniel et al.
6,635,732 B2 10/2003 Mentak
6,667,029 B2 12/2003 Zhong et al.
6,679,324 B2 1/2004 Boer et al.
6,692,766 B1 2/2004 Rubinstein et al.
6,699,503 B1 3/2004 Sako et al.
6,699,611 B2 3/2004 Kim et al.
6,786,285 B2 9/2004 Johnson et al.
6,817,416 B2 11/2004 Wilson et al.
6,840,321 B2 1/2005 Restarick et al.
6,857,476 B2 2/2005 Richards
6,863,126 B2 3/2005 McGlothen et al.
6,938,698 B2 9/2005 Coronado
6,951,252 B2 10/2005 Restarick et al.
6,976,542 B2 12/2005 Henricksen et al.
7,011,076 B1 3/2006 Weldon et al.
7,084,094 B2 8/2006 Gunn et al.
7,159,656 B2 1/2007 Eoff et al.
7,185,706 B2 3/2007 Freyer
7,290,606 B2 11/2007 Coronado et al.
7,318,472 B2 1/2008 Smith
7,322,412 B2 1/2008 Badalamenti et al.
7,325,616 B2 2/2008 Cardenas et al.
7,395,858 B2 7/2008 Barbosa et al.
7,409,999 B2 8/2008 Henriksen et al.
7,469,743 B2 12/2008 Richards
7,673,678 B2 3/2010 MacDougal et al.
2002/0020527 A1 2/2002 Kilaas et al.
2002/0125009 A1 9/2002 Wetzel et al.
2003/0221834 A1 12/2003 Hess et al.
2004/0035578 A1 2/2004 Ross et al.
2004/0052689 A1 3/2004 Yao
2004/0144544 A1 7/2004 Freyer
2004/0194971 A1 10/2004 Thomson
2005/0016732 A1 1/2005 Brannon et al.
2005/0126776 A1 6/2005 Russell
2005/0171248 A1 8/2005 Li et al.
2005/0178705 A1 8/2005 Broyels et al.
2005/0189119 A1 9/2005 Gynz-Rekowski
2005/0199298 A1 9/2005 Farrington
2005/0207279 A1 9/2005 Chamali et al.
2005/0241835 A1 11/2005 Burris et al.
2006/0042798 A1 3/2006 Badalamenti et al.
2006/0048936 A1 3/2006 Fripp et al.
2006/0048942 A1 3/2006 Moen et al.
2006/0076150 A1 4/2006 Coronado
2006/0086498 A1 4/2006 Wetzel et al.
2006/0108114 A1 5/2006 Johnson
2006/0118296 A1 6/2006 Dybevik et al.
2006/0133089 A1 6/2006 Reid et al.
2006/0175065 A1 8/2006 Ross
2006/0185849 A1 8/2006 Edwards et al.
2006/0272814 A1 12/2006 Broome et al.
2006/0273876 A1 12/2006 Pachla et al.
2007/0012444 A1 1/2007 Horgan et al.
2007/0039741 A1 2/2007 Hailey, Jr.
2007/0044962 A1 3/2007 Tibbles
2007/0131434 A1 6/2007 MacDougall et al.
2007/0246210 A1* 10/2007 Richards ..... 166/56
2007/0246213 A1 10/2007 Hailey, Jr.
2007/0246225 A1 10/2007 Hailey et al.
2007/0246407 A1 10/2007 Richards et al.
2007/0272408 A1* 11/2007 Zazovsky et al. ..... 166/278
2008/0035349 A1 2/2008 Richard
2008/0035350 A1 2/2008 Henriksen et al.
2008/0053662 A1 3/2008 Williamson et al.
2008/0135249 A1 6/2008 Fripp et al.
2008/0149323 A1 6/2008 O'Malley et al.
2008/0149351 A1 6/2008 Marya et al.
2008/0236839 A1 10/2008 Oddie
2008/0236843 A1 10/2008 Scott et al.
2008/0283238 A1 11/2008 Richards et al.
2008/0296023 A1 12/2008 Willauer
2008/0314590 A1* 12/2008 Patel ..... 166/278
2009/0056816 A1 3/2009 Arov et al.
2009/0133869 A1 5/2009 Clem

| | | | | |
|---|---|---|---|---|
| 2009/0133874 | A1 * | 5/2009 | Dale et al. | 166/278 |
| 2009/0139727 | A1 | 6/2009 | Tanju et al. | |
| 2009/0205834 | A1 | 8/2009 | Garcia et al. | |

FOREIGN PATENT DOCUMENTS

| | | | |
|---|---|---|---|
| GB | 1492345 | | 11/1977 |
| GB | 2341405 | | 12/2007 |
| JP | 59089383 | B2 | 5/1984 |
| SU | 1335677 | A | 9/1987 |
| WO | 9403743 | A1 | 2/1994 |
| WO | WO 00/79097 | | 5/2000 |
| WO | WO 01/65063 | | 2/2001 |
| WO | WO 01/77485 | | 3/2001 |
| WO | WO 02/075110 | | 9/2002 |
| WO | 2004/018833 | A1 | 3/2004 |
| WO | WO 2006/015277 | | 7/2005 |

OTHER PUBLICATIONS

An Oil Selective Inflow Control System; Rune Freyer, Easy Well Solutions; Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling & Completion, vol. 12, No. 1, March; pp. 13-18; 1997 Society of Petroleum Engineers.

Pressure Drop in Horizontal Wells and Its Effect on Production Performance; Dikken, Ben J.; SPE 19824, pp. 561-574, 1989; Koninklijke/ Shell E & P Laboratorium.

"Rapid Swelling and Deswelling of Thermoreversible Hydrophobically Modified Poly(N-Isopropylacrylamide) Hydrogels Prepared by Freezing Polymerisation". Xue, W., Hamley, I. W. and Huglin, M. B., 2002, 43(1) 5181-5186.

"Thermoreversible Swelling Behavior of Hydrogels Based on N-Isopropylacrylamide with a Zwitterionic Comonomer", Xue, W., Champ, S. amd Huglin, M. B. 2001, European Polymer Journal, 37(5) 869-875.

Dinarvand, R., D'Emanuele, A (1995) The use of thermoresponsive hydrogels for on-off release of molecules, J. Control. Rel. 36: 221-227.

Tanaka, T., Nishio, I., Sun, S.T., Ueno-Nisho, S. (1982) Collapse of gels in an electric field, Science. 218:467-469.

Ishihara,K., Hamada, N., Sato, S., Shinohara, I., (1984) Photoinduced serlling control of amphiphdilic azoaromatic polymer membrane. J. Polym. Sci., Polym. Chem. Ed. 22: 121-128.

Ricka, J. Tanaka, T. (1984) Swelling of Ionic gels: Quantitative performance of the Donnan Thory, Macromolecules, 17: 2916-2921.

Restarick, Henry. Halliburton Energy Services, SPE Member; SPE 29831 Horizontal Completion Options in Reservoirs With Sand Problems; Presented at the SPE Middle East Oil Show, Behrain, Mar. 11-14, 1995; Copyright 1995, Society of Petroleum Engineers, Inc.

Stephen P. Mathis, Baker Oil Tools, SPE; "Sand Management: A Review of Approaches and Concerns; SPE 82240"; Presented at the SPE European Formation Damage Conference, Hague, The Netherlands May 13-14, 2003; Copyright 2003, Society of Petroleum Engineers Inc.

E. Paul Bercegeay, University of Southwestern Louisiana; Charles A. Richard, Baker Oil Tools, Inc. Member AIME; "A One-Trip Gravel Packing System, SPE 4771"; Prepared for the Society of Petroleum Engineers of AIME Symposium on Formation Damage Control, New Orleans, La., Feb. 7-8, 1974; Copyright 1974, American Institute of Mining, Metallurgical and Petroleum Engineers, Inc.

* cited by examiner

FLOW RESTRICTION DEVICE

BACKGROUND OF THE DISCLOSURE

1. Field of the Disclosure

The disclosure relates generally to systems and methods for selective control of fluid flow into a production string in a wellbore.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. These production zones are sometimes separated from each other by installing a packer between the production zones. Fluid from each production zone entering the wellbore is drawn into a tubing that runs to the surface. It is desirable to have substantially even drainage along the production zone. Uneven drainage may result in undesirable conditions such as an invasive gas cone or water cone. In the instance of an oil-producing well, for example, a gas cone may cause an inflow of gas into the wellbore that could significantly reduce oil production. In like fashion, a water cone may cause an inflow of water into the oil production flow that reduces the amount and quality of the produced oil. Accordingly, it is desired to provide even drainage across a production zone and/or the ability to selectively close off or reduce inflow within production zones experiencing an undesirable influx of water and/or gas.

The present disclosure addresses these and other needs of the prior art.

SUMMARY OF THE DISCLOSURE

In aspects, the present disclosure provides an apparatus for controlling a flow of a fluid into a wellbore tubular in a wellbore. The apparatus may include a flow path configured to convey the fluid from the formation into a flow bore of the wellbore; and a plurality of flow control elements along the flow path. The flow control elements may be configured to cause changes in the inertial direction of the fluid flowing in the flow path. In embodiments, the change in inertial direction occurs at junctures along the flow path. The plurality of flow control elements may separate the fluid into at least two flow paths. The flow control elements may also be configured to cause an increase in a pressure drop in the flow path as a concentration of water increases in the fluid.

In one arrangement, the flow control elements may be configured to form a plurality of segmented pressure drops across the flow path. The plurality of segment pressure drops may include a first pressure drop segment and a second pressure drop segment that is different from the first pressure drop segment. The first pressure drop segment may be generated by a passage along the flow path. The second pressure drop may be generated by an orifice or a slot.

In one aspect, the flow path may be formed across an outer surface of a tubular at least partially surrounding the flow path. The flow path may be formed by a plurality of flow control elements defining channels. Each flow control element can include slots that provide fluid communication between the channels. In embodiments, the flow path may be formed by a plurality of serially aligned flow control elements having channels. Each flow control element may have orifices that provide fluid communication between the channels.

In aspects, the present disclosure also provides an inflow control apparatus that includes a plurality of flow control elements along a flow path that cause a plurality of segmented pressure drops in the flow path. The plurality of segmented pressure drops may include at least a first pressure drop and a second pressure drop different from the first pressure drop. The plurality of segmented pressure drops may also include a plurality of the first pressure drops and a plurality of the second pressure drops.

In aspects, the present disclosure also provides a method for controlling a flow of a fluid into a wellbore tubular in a wellbore. The method may include conveying the fluid from the formation into a flow bore of the wellbore using a flow path; and causing a plurality of changes in inertial direction of the fluid flowing in the flow path. In some arrangements, the method may include positioning a plurality of flow control elements along the flow path to cause the changes in inertial direction. The method may also include separating the fluid into at least two flow paths. In embodiments, the method may include increasing a pressure drop in the flow path as a concentration of water increases in the fluid. In embodiments, the method may also include causing a plurality of segmented pressure drops across the flow path. The plurality of segment pressure drops may include a first pressure drop segment and a second pressure drop segment that is different from the first pressure drop segment.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
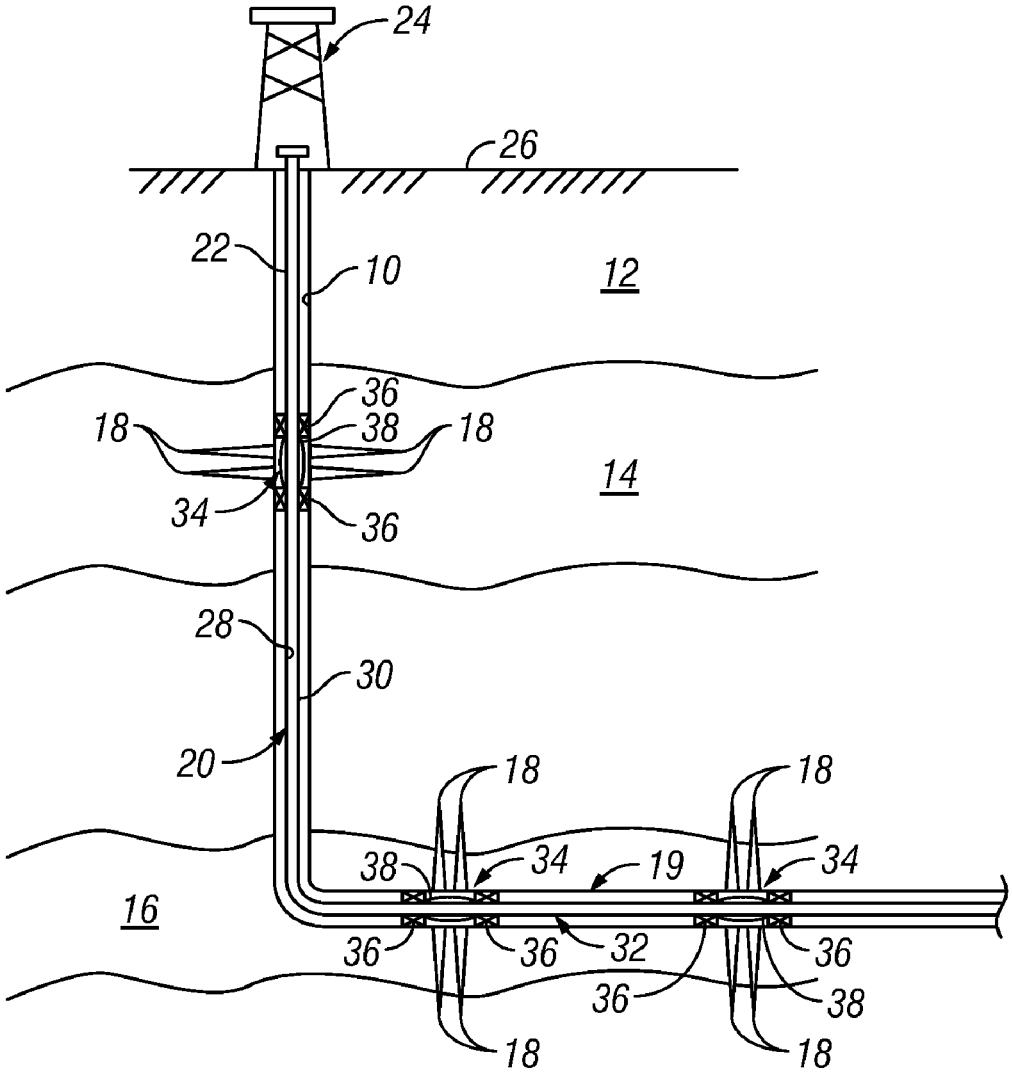
FIG. 1 is a schematic elevation view of an exemplary multi-zonal wellbore and production assembly which incorporates an inflow control system in accordance with one embodiment of the present disclosure.

The present disclosure relates to devices and methods for controlling production of a hydrocarbon producing well. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Further, while embodiments may be described as having one or more features or a combination of two or more features, such a feature or a combination of features should not be construed as essential unless expressly stated as essential.

Referring initially to FIG. 1, there is shown an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated, or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flowbore 28 along its length. An annulus 30 is defined between the production assembly 20 and the wellbore casing. The production assembly 20 has a deviated, generally horizontal portion 32 that extends along the deviated leg 19 of the wellbore 10. Production nipples 34 are positioned at selected points along the production assembly 20. Optionally, each production nipple 34 is isolated within the wellbore 10 by a pair of packer devices 36. Although only two production nipples 34 are shown in FIG. 1, there may, in fact, be a large number of such nipples arranged in serial fashion along the horizontal portion 32.

Each production nipple 34 features a production control device 38 that is used to govern one or more aspects of a flow of one or more fluids into the production assembly 20. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. In accordance with embodiments of the present disclosure, the production control device 38 may have a number of alternative constructions that ensure selective operation and controlled fluid flow therethrough.

Figure 2:
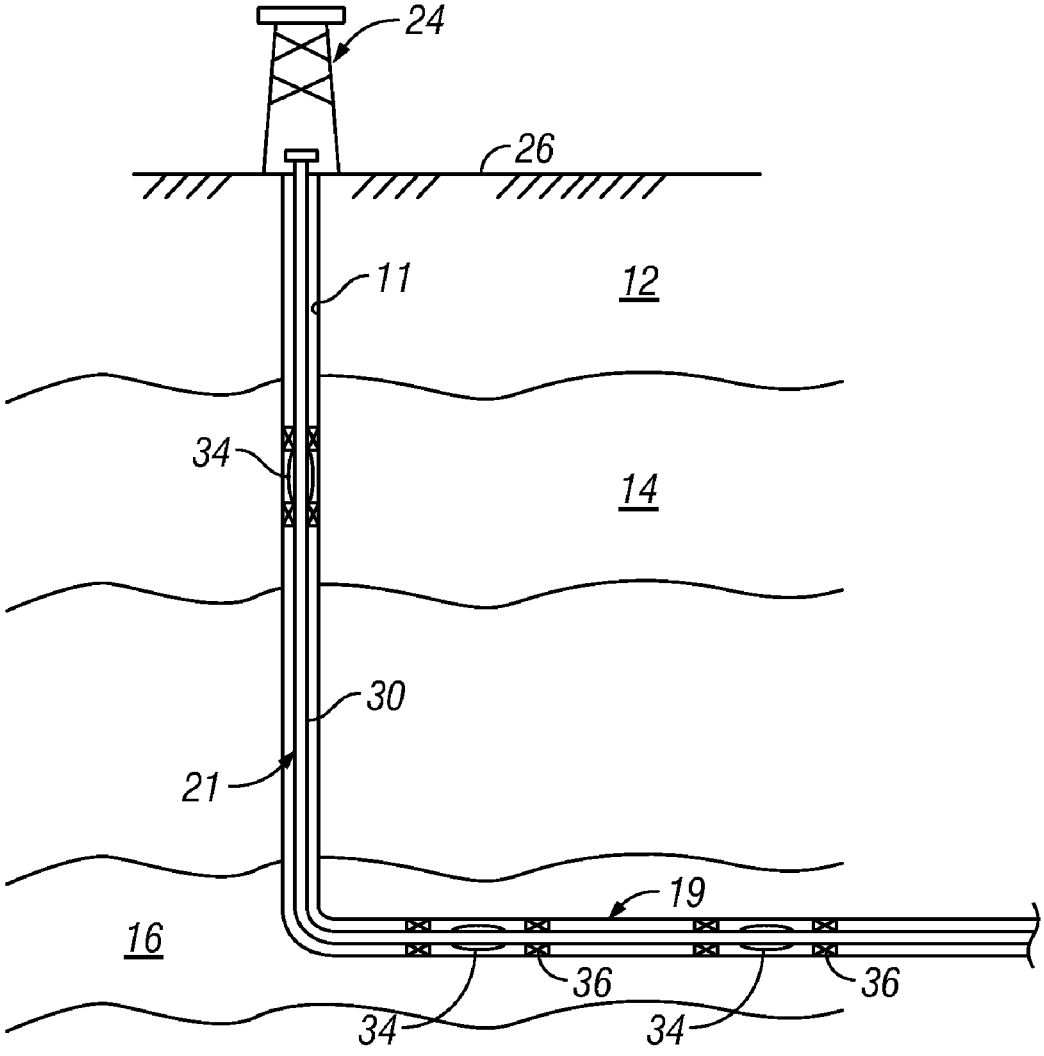
FIG. 2 is a schematic elevation view of an exemplary open hole production assembly which incorporates an inflow control system in accordance with one embodiment of the present disclosure.

FIG. 2 illustrates an exemplary open hole wellbore arrangement 11 wherein the production devices of the present disclosure may be used. Construction and operation of the open hole wellbore 11 is similar in most respects to the wellbore 10 described previously. However, the wellbore arrangement 11 has an uncased borehole that is directly open to the formations 14, 16. Production fluids, therefore, flow directly from the formations 14, 16, and into the annulus 30 that is defined between the production assembly 21 and the wall of the wellbore 11. There are no perforations, and the packers 36 may be used to separate the production nipples. However, there may be some situations where the packers 36 are omitted. The nature of the production control device is such that the fluid flow is directed from the formation 16 directly to the nearest production nipple 34.

Figure 3:
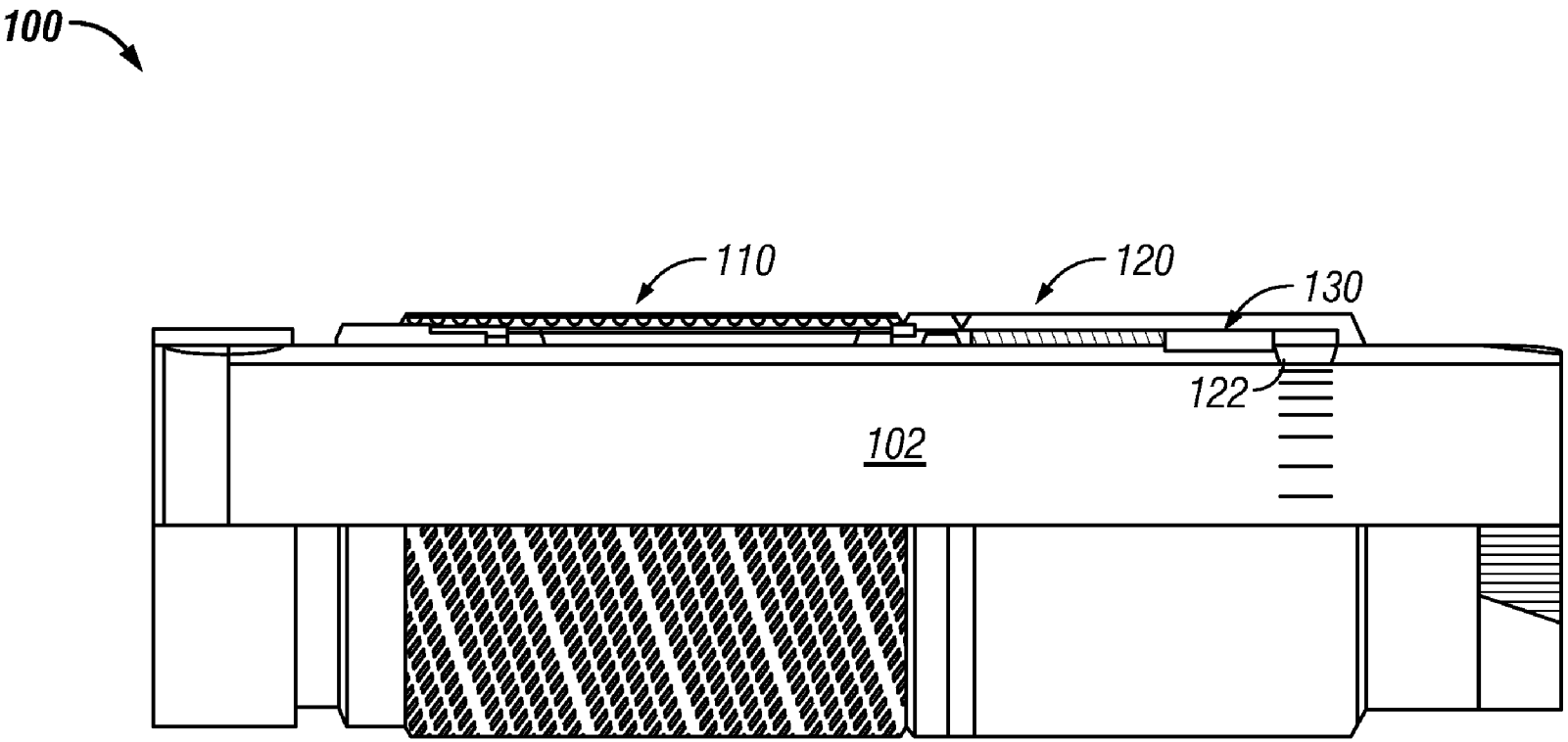
FIG. 3 is a schematic cross-sectional view of an exemplary production control device made in accordance with one embodiment of the present disclosure.

Referring now to FIG. 3, there is shown one embodiment of a production control device 100 for controlling the flow of fluids from a reservoir into a flow bore 102 of a tubular 104 along a production string (e.g., tubing string 22 of FIG. 1). This flow control can be a function of one or more characteristics or parameters of the formation fluid, including water content, fluid velocity, gas content, etc. Furthermore, the control devices 100 can be distributed along a section of a production well to provide fluid control at multiple locations. This can be advantageous, for example, to equalize production flow of oil in situations wherein a greater flow rate is expected at a "heel" of a horizontal well than at the "toe" of the horizontal well. By appropriately configuring the production control devices 100, such as by pressure equalization or by restricting inflow of gas or water, a well owner can increase the likelihood that an oil bearing reservoir will drain efficiently. Exemplary production control devices are discussed herein below.

In one embodiment, the production control device 100 includes a particulate control device 110 for reducing the amount and size of particulates entrained in the fluids and an in-flow control device 120 that controls overall drainage rate from the formation. The particulate control device 110 can include known devices such as sand screens and associated gravel packs. In embodiments, the in-flow control device 120 utilizes flow channels that control in-flow rate and/or the type of fluids entering the flow bore 102 via one or more flow bore orifices 122. Illustrative embodiments are described below.

Figure 4:
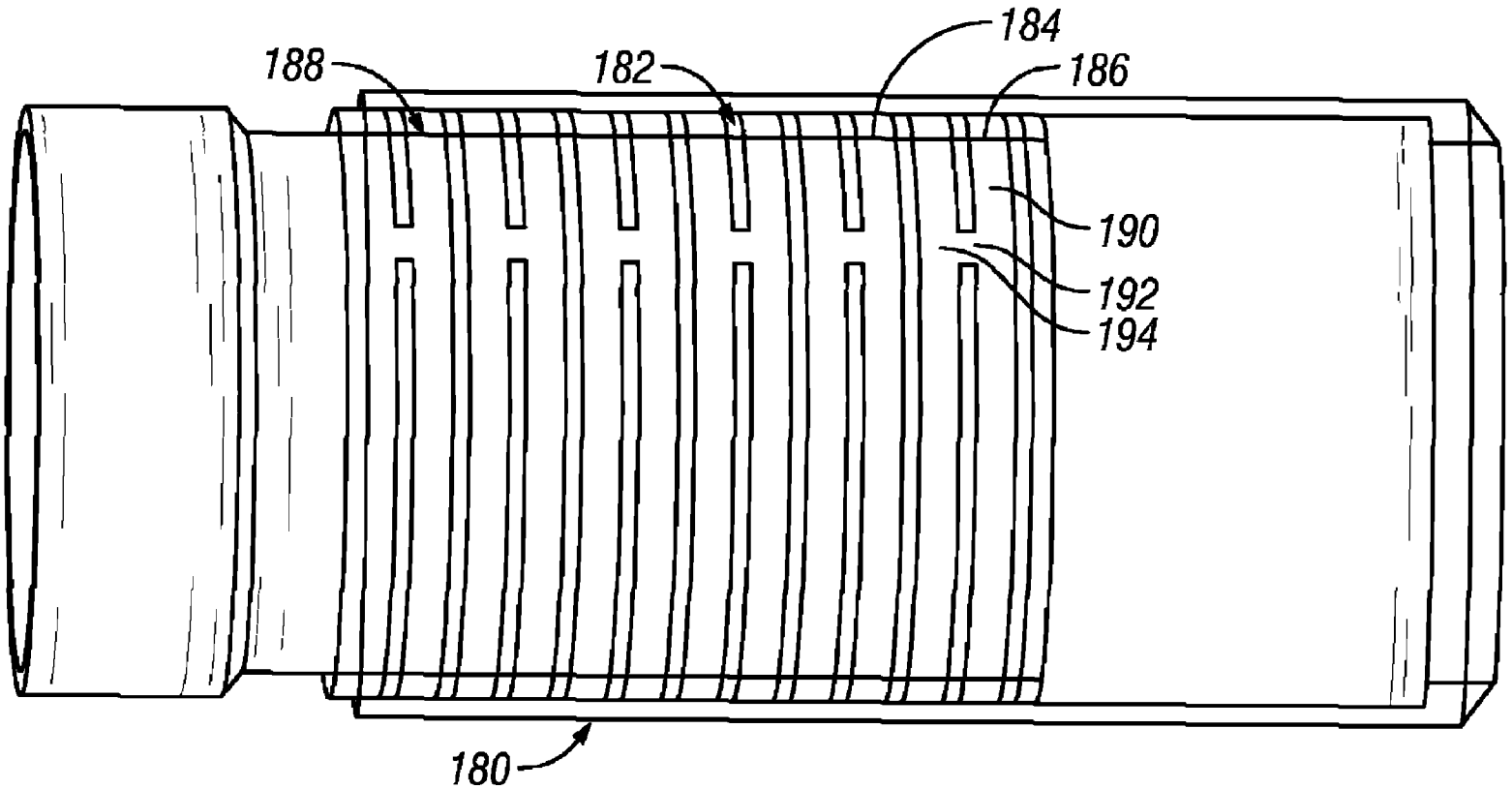
FIG. 4 is an isometric view of an in-flow control made in accordance with one embodiment of the present disclosure that uses a labyrinth-like flow path.

Referring now to FIG. 4, there is shown an exemplary in-flow control device 180 for controlling one or more characteristics of fluid flow from a formation into a flow bore 102 (FIG. 3). In embodiments, the in-flow control device 180 includes a series of flow control elements 182 that may be configured to cause a specified flow characteristic in the in-flow control device 180 for a given fluid. Exemplary characteristics include, but are not limited to, flow rate, velocity, water cut, fluid composition, and pressure. The flow control elements 182 may incorporate one or more features that control friction factors, flow path surface properties, and flow path geometry and dimensions. These features, separately or in combination, may be cause flow characteristics to vary as fluid with different fluid properties (e.g., density and viscosity) flow through the in-flow device 180. For instance, the flow control elements 182 may be configured to provide greater resistance to the flow of water than the flow of oil. Thus, the in-flow control device 180 may reduce the flow rate through the in-flow device 180 as the concentration of water, or "water cut," increases in the flowing fluid.

In one embodiment, the flow control elements 182 are formed on a sleeve 184 having an outer surface 186. The sleeve 184 may be formed as a tubular member that is received into the flow space 130 (FIG. 3) of the in-flow control device 180. In one arrangement, the flow control elements 182, which may be wall-like features, may be arranged as a labyrinth that forms a tortuous flow path 188 for the fluid flowing through the in-flow control device 180. In one embodiment, the tortuous flow path 188 may include a first series of passages 190 and a second series of passages 192. The first series of passages and the second series of passages 192 may be oriented differently from one another; e.g., the passages 190 may direct flow circularly around the sleeve 184 whereas the passages 192 may direct flow generally along the sleeve 184. The passage 190 may be formed between two flow control elements 182 and may partially or fully circumscribe the sleeve 184. The passage 192 may be formed as a slot in the flow control element 186 at a location that is one-hundred eighty degrees circumferentially offset from the passage 192 in an adjacent flow control element 186. It should be understood that the shown arrangement is merely illustrative and not exhaustive of configurations for the flow control elements 182. For example, diagonal or curved passages may also be utilized in certain applications. Moreover, while a single path 188 is shown, two or more paths may be used to convey fluid in a parallel arrangement across the in-flow control device 180.

During one exemplary use, a fluid may initially flow in a generally circular path along a passage 190 until the fluid reaches a passage 192. Then the fluid transitions to a generally axially aligned flow when passing through the passage 192. As the fluid exits the passage 192, the fluid is separated in the next passage 190 into two streams: one stream flows in a clockwise direction and another stream flows in a counter-clockwise direction. After traveling approximately one-hundred eighty degrees, the two fluid streams rejoin to flow through the next passage 192. The fluid flows along this labyrinth-like flow path until the fluid exits via the opening 122 (FIG. 3).

It should be understood that the flowing fluid encounters a change in flow direction at the junctures 194 between the passages 190 and 192. Because the junctures 194 cause a change in the inertial direction of the fluid flow, i.e., the direction of flow the fluid would have otherwise traveled, a pressure drop is generated in the flowing fluid. Additionally, the splitting and rejoining of the flowing fluid at the junctures 194 may also contribute to an energy loss and associated pressure drop in the fluid.

Additionally, in embodiments, some or all of the surfaces defining the passages 190 and 192 may be constructed to have a specified frictional resistance to flow. In some embodiments, the friction may be increased using textures, roughened surfaces, or other such surface features. Alternatively, friction may be reduced by using polished or smoothed surfaces. In embodiments, the surfaces may be coated with a material that increases or decreases surface friction. Moreover, the coating may be configured to vary the friction based on the nature of the flowing material (e.g., water or oil). For example, the surface may be coated with a hydrophilic material that absorbs water to increase frictional resistance to water flow or a hydrophobic material that repels water to decrease frictional resistance to water flow.

It should be appreciated that the above-described features may, independently or in concert, contribute to causing a specified pressure drop along the in-flow control device 180. The pressure drop may be caused by changes in inertial direction of the flowing fluid and/or the frictional forces along the flow path. Moreover, the in-flow control device may be configured to have one pressure drop for one fluid and a different pressure drop for another fluid. Other exemplary embodiments utilizing flow control elements are described below.

Figure 5A:
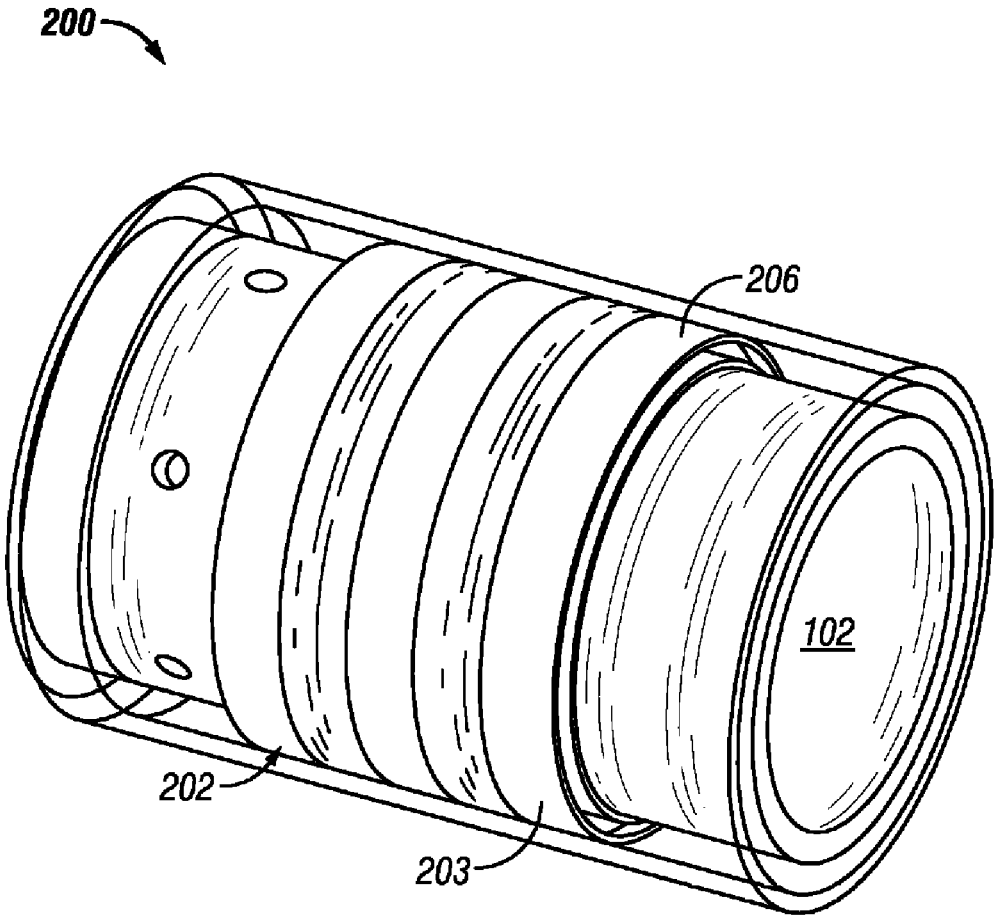
FIGS. 5A and 5B are an isometric view and a sectional view, respectively, of an in-flow control made in accordance with one embodiment of the present disclosure that uses segmented pressure drops.
Figure 5B:
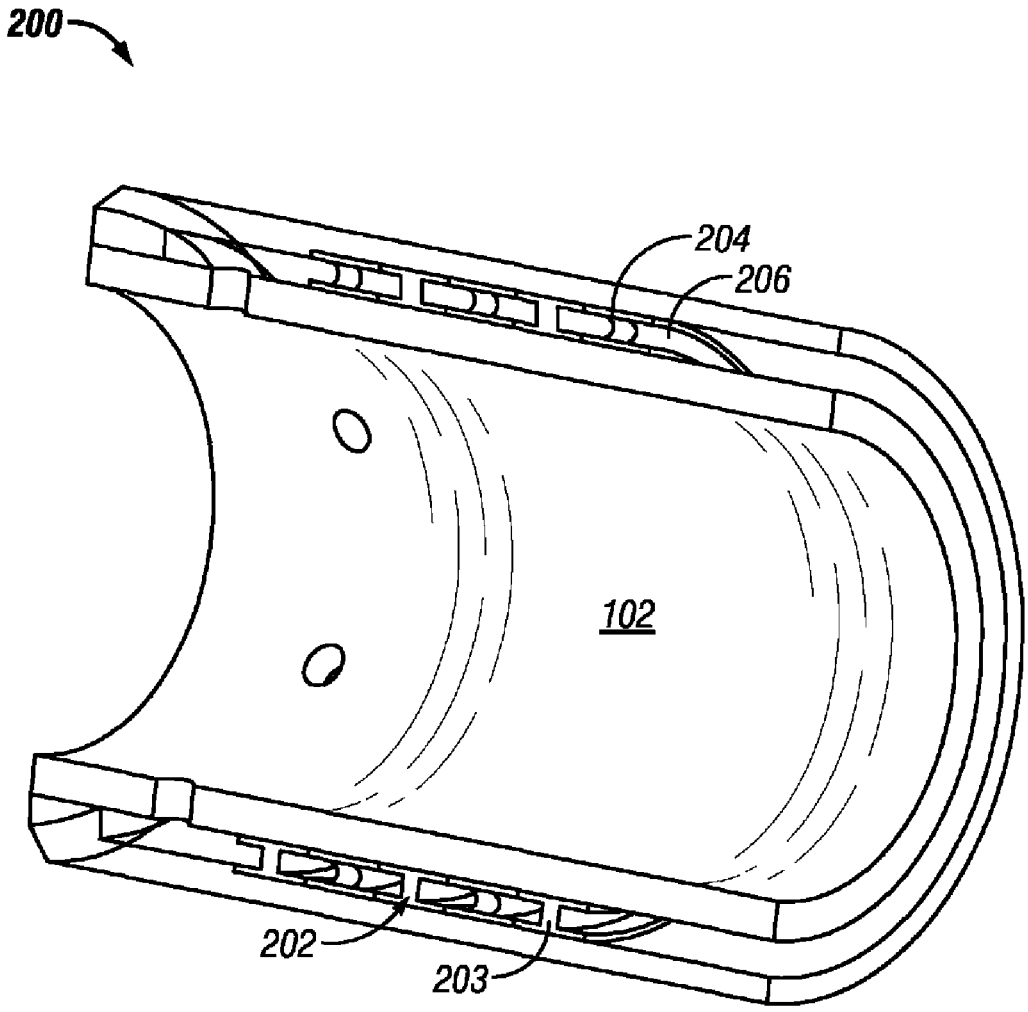

Referring now to FIGS. 5A and 5B, there is shown another exemplary in-flow control device 200 that uses one or more flow control elements 202 to control one or more characteristics of flow from a formation into a flow bore 102. In embodiments, the flow control elements 202 may be formed as plates 203. The plates 203 may be arranged in a stacked fashion between the particulate control device (FIG. 3) and the flow bore orifice 122 (FIG. 3). Each plate 203 has an orifice 204 and a channel 206. The orifice 204 is a generally circular passage, as section of which is shown in FIG. 5B. The orifices 204 and the channels 206 are oriented in a manner that fluid flowing through a flow space 130 (FIG. 3) of the in-flow control device 200 is subjected to periodic changes in direction of flow as well as changes in the configuration of the flow path. Each of these elements may contribute to imposing a different magnitude of pressure drops along the in-flow control device 200. For instance, the orifices 204 may be oriented to direct flow substantially along the long axis of the flow bore 102 and sized to provide a relatively large pressure drop. Generally speaking, the diameter of the orifices 204 is one factor that controls the magnitude of the pressure drop across the orifices 204. The channels 206 may be formed to direct flow in a circular direction around the long axis of the flow bore 102 and configured to provide a relatively small pressure drop. Generally speaking, the frictional losses caused by the channels 206 control the magnitude of the pressure drop along the channels 206. Factors influencing the frictional losses include the cross-sectional flow area, the shape of the cross-sectional flow area (e.g., square, rectangular, etc.) and the tortuosity of the channels 206. In one arrangement, the channels 206 may be formed as circumferential flow paths that run along a one-hundred eighty degree arc between orifices 204. The channels 206 may be formed entirely on one plate 203 or, as shown, a portion of each channel 206 is formed on each plate 203. Moreover, a plate 203 may have two or more orifices 204 and/or two or more channels 206.

Thus, in one aspect, the in-flow device 200 may be described as having a flow path defined by a plurality of orifices 204, each of which are configured to cause a first pressure drop and a plurality of channels 206, each of which are configured to cause a second pressure drop different from the first pressure drop. The channels 206 and the orifices 204 may alternate in one embodiment, as shown. In other embodiments, two or more channels 206 or two or more orifices 204 may be serially arranged.

In another aspect, the in-flow device 200 may be described as being configurable to control both the magnitude of a total pressure drop across the in-flow control device 200 and the manner in which the total pressure drop is generated across the in-flow control device 200. By manner, it is meant the nature, number and magnitude of the segmented pressure drops that make up the total pressure drop across the in-flow control device 200. In one illustrative configurable embodiment, the plates 203 may be removable or interchangeable. Each plate 203 may have the one or more orifices 204 and one or more channels 206. Each plate 203 may have the same orifices 204 (e.g., same diameter, shape, orientation, etc.) or different orifices 204 (e.g., different diameter, shape, orientation, etc.). Likewise, each plate 203 may have the same channels 206 (e.g., same length, width, curvature, etc.) or different channels 206 (e.g., different length, width, curvature, etc.). As described previously, each of the orifices 204 generates a relatively steep pressure drop and each of the channels 206 generates a relatively gradual pressure drop. Thus, the in-flow control device 200 may be configured to provide a selected total pressure drop by appropriate selection of the number of plates 203. The characteristics of the segments of pressure drops making up the total pressure drop may controlled by appropriate selection of the orifices 204 and the channels 206 in the plates 203.

Figure 6:
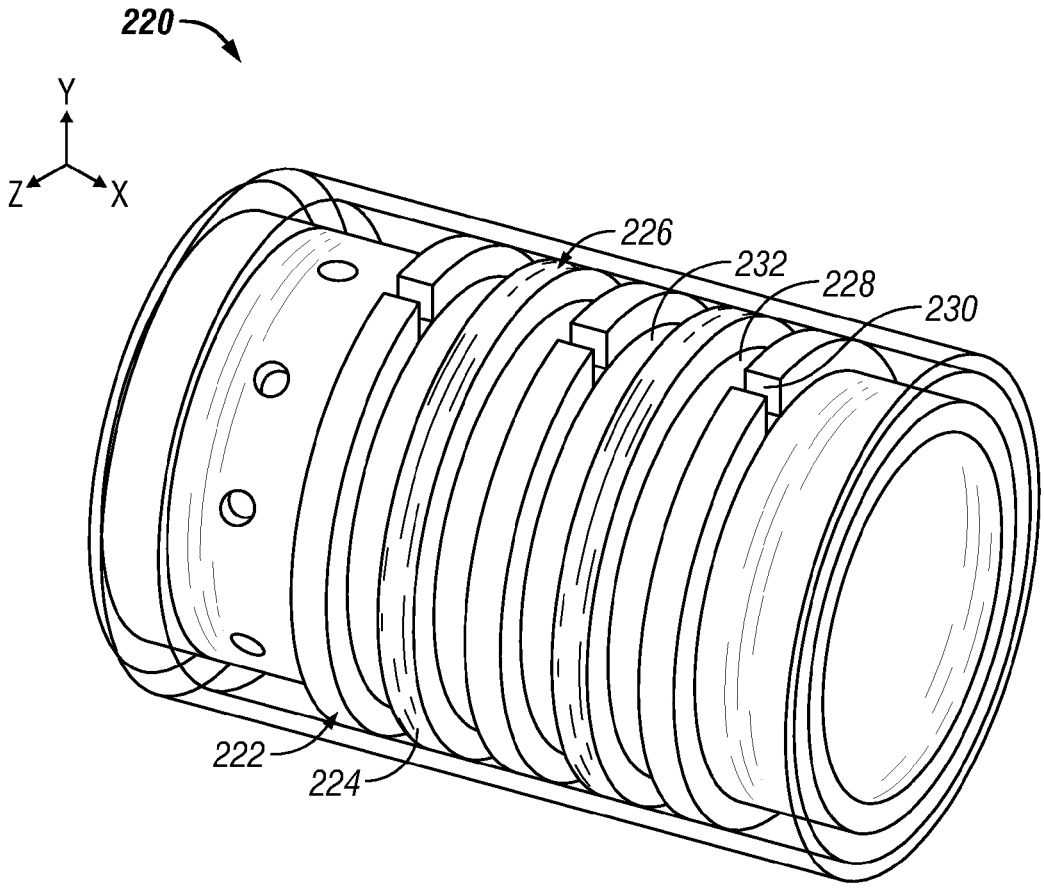
FIG. 6 is an isometric view of another inflow control device made in accordance with one embodiment of the present disclosure that uses segmented pressure drops.

Referring now to FIG. 6, there is shown another exemplary in-flow control device 220 for controlling one or more characteristics of flow from a formation into a flow bore 102. In embodiments, the in-flow control device 220 includes a sleeve 222 having an outer surface 224 on which are formed of a series of flow control elements 226. The sleeve 202 may be formed as a tubular member that is received into the flow space 130 (FIG. 3) of the in-flow control device 220. In one arrangement, the flow control elements 226 may be formed as ribs that form a tortuous flow path 228 for the fluid entering the in-flow control device 220. The tortuous flow path 228 may include a series of relatively narrow slots 230 and relatively wide channels 232. The passages 230 may be formed in the flow control elements 226 and may provide a relatively steep pressure drop in a manner analogous to the orifices 204 of FIG. 5A. The channels 232 may be formed between the flow control elements 226 and provide a relatively gradual pressure drop in a manner analogous to the channels 206 of FIG. 5A. The narrow slots 230 and the wide channels 232 are oriented in a manner that fluid flowing through the in-flow control device 220 is subjected to periodic changes in direction of flow as well as changes in the configuration of the flow path 228. In a manner previously described, each of these features may contribute to imposing a different magnitude of pressure drops along the in-flow control device 220. Generally speaking, the length, width, depth and quantity of the narrow slots 230 control the magnitude of the pressure drop across the narrow slots 230. Generally speaking, the frictional losses caused by the channels 232 control the magnitude of the pressure drop along the channels 232. Factors influencing the frictional losses include the cross-sectional flow area and the tortuosity of the channels 232. In one arrangement, the channels 232 may be formed as circumferential flow paths that run along a one-hundred eighty degree arc between slots 230. While the narrow slots 230 are shown aligned with the axis of the flow bore 102 and the wide channels 232 are shown to direct flow in circumferentially around the long axis of the flow bore 102, other directions may be utilized depending on the desired flow characteristics.

Figure 7:
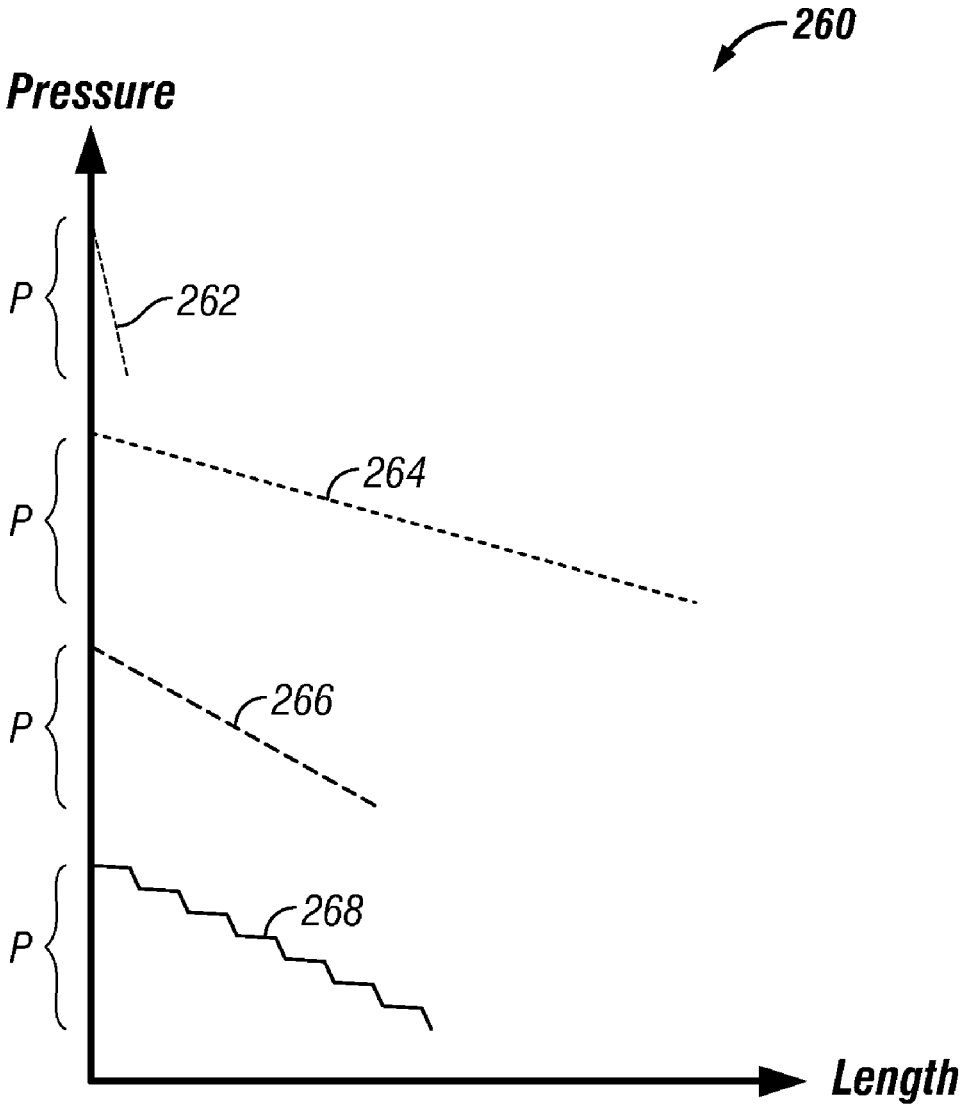
FIG. 7 graphically illustrates pressure drops associated with various in-flow control devices.

Referring now to FIG. 7, there is graphically shown illustrative pressure drops associated with various pressure drop arrangements that may be used in connection with in-flow control devices. The graph 260 shows, in rather generalized form, a plot of pressure versus length of an in-flow control device. Line 262 roughly represents a pressure drop across an orifice. Line 264 roughly represents a pressure drop across a helical flow path. Line 266 roughly represents a pressure drop across the FIG. 4 embodiment of an in-flow control device. Line 268 roughly represents a pressure drop across the FIG. 5 or FIG. 6 embodiments of an in-flow control device. To better illustrate the teachings of the present disclosure, the lines 262-268 are intended to show, for a given pressure drop (P), the differences in the general nature of a pressure drop and the length that may be needed to obtain the pressure drop (P). As can be seen in line 262, an orifice causes a relatively steep pressure drop over a very short interval, which may generate flow velocities that wear and corrode the orifice. A helical flow path, as shown in line 264, provides a graduated pressure drop and does not generate high flow velocities. The length needed to generate the pressure drop (P), however, may be longer than that needed for an orifice.

As seen in line 266, the FIG. 4 in-flow control device obtain the pressure drop (P) in a shorter length. This reduced length may be attributed to the previously-described changes in inertial direction that, in addition to the frictional forces generated by the flow surfaces, generate controlled pressure drops in the flow path. Line 266 is shown as a graduated drop because the pressure drops associated with the changes in inertial direction may be approximately the same as the pressure drops associated with frictional losses. In other embodiments, however, the changes in inertial direction may create a different pressure drop that those caused by frictional forces.

As seen in line 268, the FIGS. 5A-B and 6 in-flow control devices utilize segmented pressure drops to obtain the pressure drop (P). The pressure drop segments associated with the orifices 204 (FIGS. 5A-B) are larger than the pressure drop segments associated with the passages 206 (FIGS. 5A-B), which leads to the "stairs" or stepped reduction in pressure. In some embodiments, the segmented pressure drops may be utilized to reduce a required length of an in-flow control device. In other embodiments, the FIGS. 5A-B and 6 devices may be constructed for particular types of oil (e.g., heavy oils).

As should be appreciated with reference to lines 266 and 268, the in-flow control devices of the present disclosure may reduce the length needed to obtain the pressure drop (P) as compared to a helical flow path but still avoid the high flow velocities associated with an orifice.

It should be understood that FIGS. 1 and 2 are intended to be merely illustrative of the production systems in which the teachings of the present disclosure may be applied. For example, in certain production systems, the wellbores 10, 11 may utilize only a casing or liner to convey production fluids to the surface. The teachings of the present disclosure may be applied to control flow through these and other wellbore tubulars.

For the sake of clarity and brevity, descriptions of most threaded connections between tubular elements, elastomeric seals, such as o-rings, and other well-understood techniques are omitted in the above description. Further, terms such as "slot," "passages," and "channels" are used in their broadest meaning and are not limited to any particular type or configuration. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. An apparatus for controlling a flow of a fluid into a wellbore tubular in a wellbore, comprising:

a flow path configured to convey the fluid from a formation into a flow bore of the wellbore tubular; and a plurality of flow control elements along the flow path, the plurality of flow control elements configured to cause a segmented pressure drop along the flow path by using a plurality of changes in inertial direction of the fluid flowing in the flow path, the segmented pressure drop including at least a first pressure drop associated with a passage formed in at least one of the flow control elements and a second pressure drop associated with a channel formed between two flow control elements, wherein the second pressure drop is more graduated that the first pressure drop, wherein the plurality of flow control elements are ribs formed on a tubular positioned in the flow path, and wherein the plurality of flow control elements separate the fluid into at least two flow paths at a first juncture in the channel and rejoin the separated fluid at a second juncture in the channel.

2. The apparatus according to claim 1 wherein the plurality of flow control elements are configured to cause an increase in a pressure drop in the flow path as a concentration of water increases in the fluid.

3. The apparatus of claim 1 wherein the passage is a non-circular slot.

4. The apparatus according to claim 1, and wherein the flow control elements include circumferentially offset slots that provides fluid communication with the channel.

5. The apparatus according to claim 1 further comprising a plurality of junctures along the flow path, the change in inertial direction occurring at each juncture.

6. A method for controlling a flow of a fluid into a wellbore tubular in a wellbore, comprising:

specifying a pressure drop for a fluid flowing along a flow path between a formation and a flow bore the wellbore tubular;

causing a segmented pressure drop along the flow path by using a plurality of changes in inertial direction of the fluid flowing in the flow path, wherein the flow path includes a plurality of flow control elements, wherein the segmented pressure drop including at least a first pressure drop associated with a passage formed in at least one of the flow control elements and a second pressure drop associated with a channel formed between two flow control elements, wherein the second pressure drop is more graduated that the first pressure drop, wherein the plurality of flow control elements are ribs formed on a tubular positioned in the flow path, and wherein the plurality of flow control elements separate the fluid into at least two flow paths at a first juncture in the channel and rejoin the separated fluid at a second juncture in the channel.

7. The method according to claim 6 further comprising increasing a pressure drop in the flow path as a concentration of water increases in the fluid.

8. The method according to claim 6 further comprising causing the first pressure drop segment using axial flow and the second pressure drop using circumferential flow.

9. The method according to claim 8, further comprising causing a plurality of first and second pressure drop segments to form the specified segmented pressure drop.

10. An apparatus for controlling a flow of a fluid between a wellbore tubular and a formation, comprising:

a housing having a flow space configured to convey the fluid between the formation and a flow bore of the wellbore tubular;

a tubular positioned in the flow space; and a plurality of rib elements formed on the tubular and configured to form a labyrinth flow path at least partially across the flow space, at least one of the rib elements having at least one slot for conveying fluid into a channel separating at least two of the rib elements, wherein the at least one slot creates a greater pressure drop than the channel.

11. The apparatus of claim 10, wherein the at least one slot has a non-circular cross-sectional flow area.

12. The apparatus of claim 10 wherein the plurality of rib elements are configured to split and rejoin a fluid in the channel.

13. The apparatus of claim 2, wherein the increase in a pressure drop in the flow path as a concentration of water increases in the fluid is caused by at least one flow control element feature selected from a group consisting of: (i) a friction factor, (ii) flow path surface property, (iii) a flow path geometry, and (iv) a dimension.

* * * * *